US006121937A

United States Patent [19]

Podger

[11] Patent Number: 6,121,937

[45] Date of Patent: Sep. 19, 2000

[54] LOG-PERIODIC STAGGERED-FOLDED-DIPOLE ANTENNA

[76] Inventor: James Stanley Podger, 55 Gradwell Drive, Scarborough ON, Canada, M1M 2N1

[21] Appl. No.: 09/352,146

[22] Filed: Jul. 13, 1999

[30] Foreign Application Priority Data

Jan. 26, 1999 [CA] Canada ..... 2260380

[51] Int. Cl.[7] ..... H01Q 11/10

[52] U.S. Cl. ..... 343/792.5; 343/803; 343/812

[58] Field of Search ..... 343/792.5, 803, 343/811, 810, 812, 814, 816, 793

[56] References Cited

U.S. PATENT DOCUMENTS

| | | | |
|---|---|---|---|
| 3,210,767 | 10/1965 | Isbell | 343/792.5 |
| 3,875,572 | 4/1975 | Kay | 343/803 |
| 4,468,674 | 8/1984 | Blonder | 343/815 |
| 4,506,268 | 3/1985 | Kuo | 343/792.5 |
| 5,790,082 | 8/1998 | Podger | 343/792.5 |
| 5,945,962 | 8/1999 | Harrington et al. | 343/792.5 |
| 5,969,687 | 10/1999 | Podger | 343/742 |
| 5,995,060 | 11/1999 | Podger | 343/807 |
| 6,020,857 | 2/2000 | Podger | 343/742 |

FOREIGN PATENT DOCUMENTS

94/21006 9/1994 WIPO .

*Primary Examiner*—Don Wong
*Assistant Examiner*—Ephrem Alemu

[57] ABSTRACT

A folded-dipole antenna element, that is modified so that the two matching conductors are located on opposite sides of the main conductor. Such staggered folded dipoles are superior for constructing log-periodic antennas, because they allow relatively small and straight feeder conductors and they allow the whole antenna to be grounded.

12 Claims, 1 Drawing Sheet

LOG-PERIODIC STAGGERED-FOLDED-DIPOLE ANTENNA

FIELD OF THE INVENTION

This invention relates to antennas, specifically antennas designed to operate over wide bands of frequencies. This application is the U.S. version of Canadian patent application 2,260,380. Heretofore, log-periodic arrays of half-wave dipoles have been a common choice for wide-band service. Unfortunately, the nature of such antennas makes it challenging to feed the dipoles in the center, to support the dipoles physically, and to have the whole structure grounded for direct current, as would be desired. This disclosure introduces the use of a new kind of folded dipole in such antennas to solve those problems.

LIST OF DRAWINGS

The background of this invention as well as the objects and advantages of this invention will be apparent from the following description and appended drawings, wherein.

PRIOR ART—REGULAR DIPOLES

The log-periodic dipole antenna, disclosed by Isbell in his U.S. Pat. No 3,210,767, has been very popular for television broadcast reception and for wide-band military, diplomatic, and amateur-radio applications. The merit of such arrays is a relatively constant impedance at the terminals and a reasonable radiation pattern across the design frequency range. The performance can be improved by using larger structures, such as loops, instead of half-wave dipoles, but such structures use space perpendicular to the plane of the dipoles. If that space were not available, perhaps because there was a need to put other antennas in that space, such superior structures would not be available.

As the log-periodic dipole was originally disclosed, the centers of the dipoles are connected by two conductors. Hereinafter in this description and the attached claims, these conductors will be called the feeder conductors. By alternately connecting the left and right sides of the dipoles to the two feeder conductors, a phase reversal is achieved between each pair of dipoles. These feeder conductors are both the electrical connecting means of the dipoles as well as their means of physical support. Therefore, these feeder conductors may not be grounded. Not only does this mean that the supporting feeder conductors must be supported by insulators, which is inconvenient, but also that the dipoles are not grounded. For a certain amount of lightning protection, it usually is wise to have antennas directly connected to ground so that the best path to ground does not go through the equipment attached to the antenna.

A popular tactic is to connect the dipoles to the boom, instead of to the feeder conductors, by means of insulators. Then the dipoles are connected to each other by wires that cross each other between the dipoles. Not only does this system not ground the dipoles, but the spacing between the feeder conductors is not uniform and, therefore, the characteristic impedance of the transmission line formed by these feeder conductors is not constant, as the original research assumed.

PRIOR ART—FOLDED DIPOLES

Figure 1:
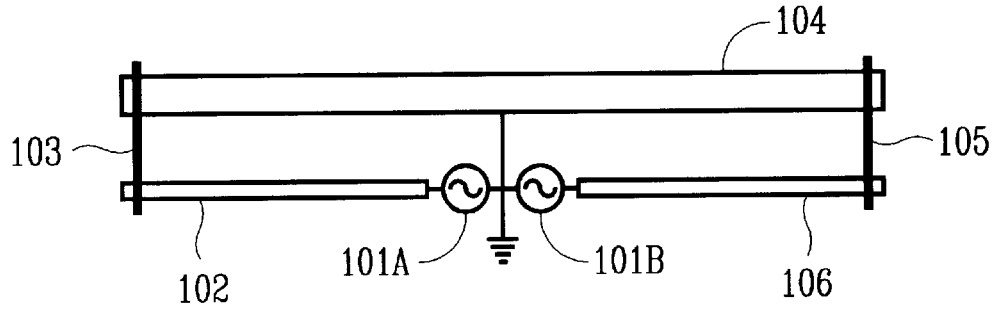
Fig. 1 Prior Art
FIG. 1 illustrates a traditional folded dipole.

The essence of the problem is that half-wave dipoles, by themselves, may not be grounded. That is not true of the conventional folded dipole of FIG. 1 having parts 101A, 101B and 102 to 106. Hereinafter in this description and the attached claims, part 104 will be called the main conductor, parts 102 and 106 will be called the matching conductors, and parts 103 and 105 will be called the shorting conductors. This is fairly conventional terminology for a dipole and a T matching system. The two generator symbols, 101A and 101B, imply that the folded dipole should be connected to the associated electronic equipment in a balanced manner with respect to ground. Therefore, the junction of the two generators would be at ground potential and could be connected to the ground.

Hereinafter in this description and the attached claims, the associated electronic equipment will be the equipment usually connected to antennas. That would include not only receivers and transmitters for communications, but also would include such devices as radar equipment and security equipment.

At any two points on the matching conductors, 102 and 106, that are equidistant as 18 from the generators, it is apparent that the two voltages must be of equal magnitude and of opposite polarity at any particular time. Likewise, that also must be true for any two corresponding points on the shorting conductors, 103 and 105, or on the main conductor, 104. The center point on the main conductor must have voltages of equal magnitude and of opposite polarity to itself. The only voltage that satisfies those criteria is zero volts. That is, if the structure were fed in a balanced manner with respect to ground, the center of the main conductor also would be at ground potential and, therefore, it could be directly connected to the junction of the generators and to a grounded boom. James C. Kay's U.S. Pat. No. 3,875,572 shows the use of folded dipoles in a log-periodic array, however he puts tuning stubs in the center of the main conductors instead of connecting the main conductors directly to the boom.

Staggered Folded Dipoles

The use of conventional folded dipoles in a log-periodic antenna can solve the problem of the antenna not being grounded, but it does not address the requirement that the feeder connections be switched between each pair of dipoles. However, if the matching conductors were placed on opposite sides of the main conductor, as in FIG. 2, with parts 201A, 201B and 202 to 206, this latter problem also would be solved. By simply alternating the positions of the matching conductors, 204 and 206, the switching of the connections between the adjacent folded dipoles can be accomplished with straight, constant-impedance feeder conductors. Hereinafter, such folded dipoles will be called staggered folded dipoles.

Figure 2:
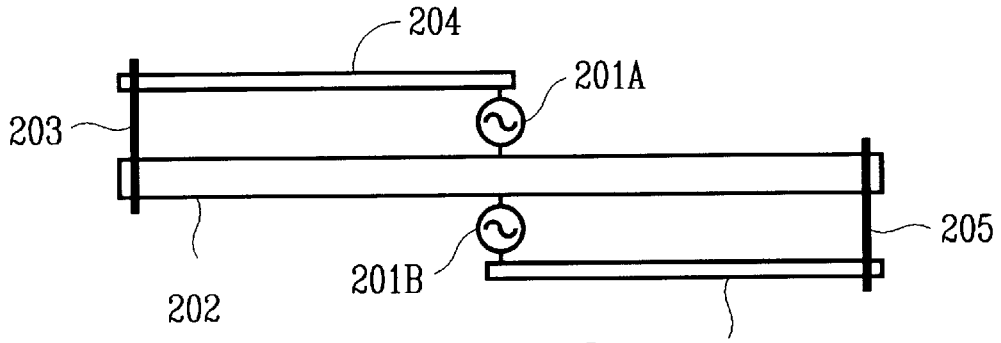
FIG. 2 illustrates the new kind of folded dipole.

As its true of many antennas, staggered folded dipoles can be made using solid rods or tubing of almost any cross-sectional shape or diameter, but circular cross-sections usually are preferred. FIG. 2 somewhat illustrates this by showing the main conductor (202) and matching conductors (204 and 206) as tubing, while showing the shorting conductors (203 and 205) as solid rods. Since the main conductors usually would be supporting the rest of the structure, one would expect that the main conductors would have larger diameters than the remaining conductors, as FIG. 2 shows. However, an antenna for the ultra-high frequencies may use only one size of conductors, because not much strength may be needed in any of the parts.

The possibility of having different conductor diameters also yields another advantage of folded dipoles. By changing the ratio of the matching conductor diameters to the main conductor diameter, a considerable change in the impedance may be obtained. The impedance also may be changed by changing the perpendicular distance between the conductors. This facility may be very useful in matching the antenna to the associated electronic equipment.

Log-Periodic Arrays

Figure 3:
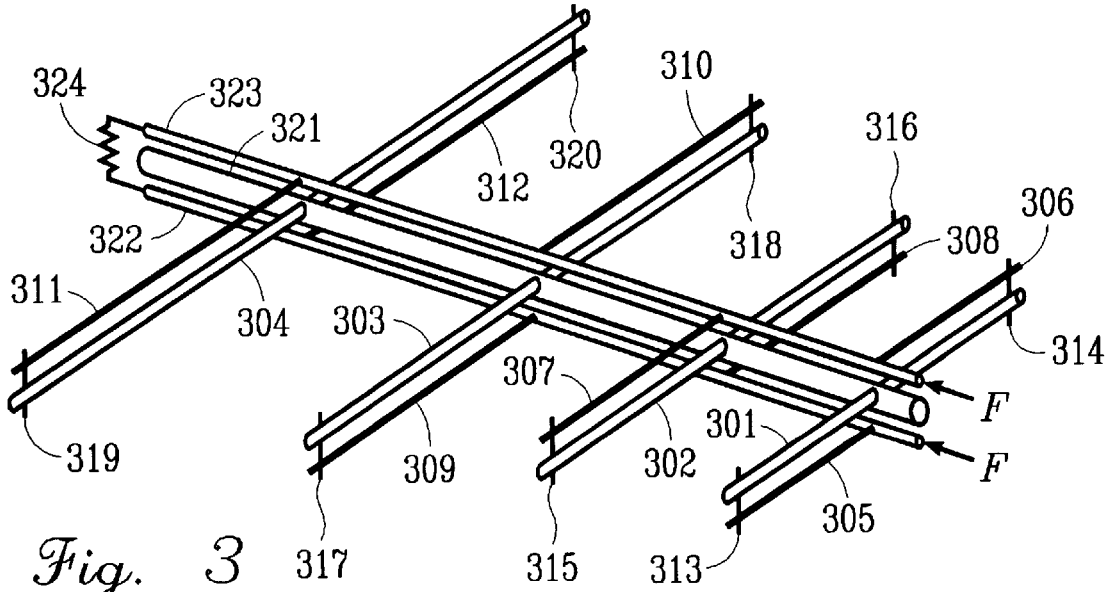
FIG. 3 illustrates a log-periodic antenna using the new kind of folded dipoles, which is the subject of this patent.

FIG. 3, with parts 301 to 324, shows a log-periodic antenna with such staggered folded dipoles. Like regular log-periodic dipole antennas, there probably would be more staggered folded dipoles than just the four in FIG. 3, but limiting the number to four more clearly shows the nature of the antenna. Hereinafter, these antennas will be called log-periodic staggered-folded-dipole antennas. Notice that the connections to the feeder conductors, 322 and 323, alternate between the adjacent staggered folded dipoles. For example, the left-hand matching conductor of the largest staggered folded dipole, 311, is connected to the top feeder conductor, 323, but the left-hand matching conductor of the next staggered folded dipole, 309, is connected to the lower feeder conductor, 322. Notice also that the main conductors, 301 to 304, are all connected to the boom, 321, which should be grounded and, through them, all the other conductors could be grounded for direct currents.

The design principles of log-periodic staggered-folded-dipole antennas are similar to the traditional principles of log-periodic dipole arrays. However, the details would be different in some ways. The scale factor ($\tau$) and spacing factor ($\sigma$) usually are defined in terms of the dipole lengths and, therefore, they can be used as is. The scale factor is the ratio of the lengths of adjacent dipoles. The scale factor also could be interpreted as the ratio of the resonant wavelengths of adjacent staggered folded dipoles. The spacing factor could be interpreted as the ratio of the individual space to the resonant wavelength of the larger of the two staggered folded dipoles adjacent to that space. For example, the spacing factor would be the ratio of the space between the two largest staggered folded dipoles to the resonant wavelength of the largest structure.

Some other standard factors may need more than reinterpretation. For example, since the impedances of staggered folded dipoles are not the same as the impedances of conventional dipoles, the usual impedance calculations for log-periodic dipole antennas are not very useful. Also, since this antenna uses some staggered folded dipoles that are larger and some that are smaller than resonant structures at any particular operating frequency, the design must be extended to frequencies beyond the operating frequencies. For log-periodic dipole antennas, this is done by calculating a bandwidth of the active region, but there is no such calculation available for the staggered folded dipoles. Since the criteria used for determining this bandwidth of the active region were quite arbitrary, this bandwidth may not have satisfied all uses of log-periodic dipole antennas either.

However, if the array had a constant scale factor and a constant spacing factor, the structures were connected with a transmission line having a velocity of propagation near the speed of light, like the feeder conductors 322 and 323, and the connections were reversed between each pair of structures, the result would be some kind of log-periodic array. The frequency range, the impedance, and the gain of such an antenna may not be what the particular application requires, but it will nevertheless be a log-periodic antenna. The task is just to start with a reasonable trial design and to make adjustments to achieve an acceptable design.

This approach is practicable because computer programs allow us to test antennas before they exist. No longer is it necessary to be able to calculate the dimensions with reasonable accuracy before an antenna must be made in the real world. The calculations can now be put into a computer spreadsheet, so the mechanical results of changes can be seen almost instantly. If the mechanical results of the calculations seemed promising, an antenna simulating program could show whether the design was electrically acceptable to a reasonable degree of accuracy.

Design Tactics

To get a trial log-periodic design, the procedure may be as follows. What would be known is the band of frequencies to be covered, the desired gain, the desired suppression of radiation to the rear, the desired length of the array, and the number of staggered folded dipoles that could be tolerated because of the weight and cost. The first factors to be chosen would be the scale factor ($\tau$) and the spacing factor ($\sigma$). The scale factor should be rather high to obtain proper operation, but it is a matter of opinion how high it should be. Perhaps a value of 0.88 would be a reasonable minimum value. A higher value would produce more gain. The spacing factor has an optimum value for good standing wave ratios across the band, good suppression of the radiation to the rear, and a minimum number of staggered folded dipoles for a particular gain. Perhaps it is a good value to use to start the process.

$$\sigma_{opt}=0.2435\tau-0.052$$

Since the resonant frequencies of the largest and smallest staggered folded dipoles cannot be calculated yet, it is necessary just to choose a pair of frequencies that are reasonably beyond the actual operating frequencies. These chosen frequencies allow the calculation of the number (N) of staggered folded dipoles needed for the trial value of scale factor ($\tau$).

$$N=1+\log(f_{min}/f_{max})/\log(\tau)$$

Note that this value of N probably would not be an integer, which it obviously must be. The values chosen above must be changed to avoid fractional numbers of staggered folded dipoles.

The calculation of the length of the array requires the calculation of the wavelength of the largest staggered folded dipole. This can, of course, be done in any units.

$$\lambda_{max}=9.84\times10^8/f_{min}\ \text{ft}$$

$$\lambda_{max}=3\times10^8/f_{min}\ \text{m}$$

The length would be in the same units as the maximum wavelength.

$$L=\lambda_{max}\sigma(1-f_{min}/f_{max})/(1-\tau)$$

Therefore, the input to the calculations could be $f_{min}$, $f_{max}$, $\tau$ and $\sigma$, and the desired results could be N and L. Using the optimum value of the spacing factor, the calculation usually would produce a design that was longer than was tolerable. If a longer length could be tolerated, the scale factor could be increased to obtain more gain. To reduce the length, the prudent action usually is to reduce the spacing factor, not the scale factor, because that choice usually will maintain a reasonable frequency-independent performance.

Once a tolerable mechanical design is revealed by these calculations, it should be tested by an antenna simulating program. The largest staggered folded dipole would be designed to be a half-wavelength long at the lowest design frequency ($f_{min}$) Then, the dimensions of the remaining structures would be obtained by successively multiplying by the scale factor. The spaces between the structures would be obtained by multiplying the wavelength of the larger adjacent structure by the spacing factor. Finally, another factor needed for the program would be the distance between the feeder conductors. For good operation this distance should produce a relatively high characteristic impedance. Unless the scale factor were rather high, a minimum characteristic impedance of 200 ohms perhaps would be prudent. That is, the characteristic impedance between each feeder conductor and the boom should be more than 100 ohms.

The gain, front-to-back ratio, and standing wave ratio of this first trial probably would indicate that the upper and lower frequencies were not acceptable. At least, the spacing between the feeder conductors probably should be modified to produce the best impedance across the band of operating frequencies. Reflecting the knowledge gained, new values would be entered into the calculations to get a second trial design.

What is an acceptable performance is, of course, a matter of individual requirements and individual standards. For that reason, variations from the original recommended practice for log-periodic dipole antennas are common. First, the optimum value of the spacing factor usually is not used because it would make the antennas too long.

Secondly, although an extension of the feeder conductors behind the longest dipole was recommended in early literature, it is seldom used. Traditionally, it would be about an eighth of a wavelength long at the lowest frequency and terminated in the characteristic impedance of the feeder conductors, which is represented by the resistance symbol 324. It was more common practice to make the termination a short circuit. If the antenna were designed for proper operation, the current in the termination would be very small anyway, so the termination would do very little and probably could be eliminated. Actually, extending or not extending the feeder conductors may not be the significant choice. There may be a limit to the length of the feeder conductors. In that case, the choice may be to raise the spacing factor to use the whole available length to support the staggered folded dipoles or to spend a part of that available length for an extension.

Note that the transmission line connecting the staggered folded dipoles in FIG. 3 includes the boom if, as is usual, the boom were metallic. That is, if there were an extension, both the boom and the feeder conductors should be extended.

The log-periodic array of FIG. 3 illustrates the appropriate connecting points, F, to serve a balanced transmission line leading to the associated electronic equipment. Other tactics for feeding unbalanced loads and higher impedance balanced loads also are used with log-periodic dipole antennas. Because these matching tactics depend only on some kind of log-periodic structure connected to two parallel tubes, these conventional tactics are as valid for such an array of staggered folded dipoles as they are for such arrays of half-wave dipoles. However, note that the tactic of connecting dipoles with crossing wires, not tubes, does not allow these matching tactics because they involve coaxial cables inserted into the tubes.

Conclusion

Except for the practical restrictions of size, weight and cost, log-periodic staggered-folded-dipole antennas could be used for most of the purposes that antennas are used. Beside the obvious needs to communicate sound, pictures, data, etc., they also could be used for such purposes as radar or for detecting objects near them for security purposes. They also could be positioned to produce horizontal polarization, vertical polarization, or any polarization between those conventional choices. While this invention has been described in detail, it is not restricted to the exact embodiments shown. These embodiments serve to illustrate some of the possible applications of the invention rather than to define the limitations of the invention.

What is claimed is:

1. An antenna structure comprising:

(a) a main conductor that is approximately straight;

(b) a first matching conductor, that is approximately straight, that has a length that is approximately one-half of the length of said main conductor, that is disposed approximately parallel to said main conductor, that is disposed so that the distance from the first end of said first matching conductor to the first end of said main conductor is much less than the length of the operating wavelength, and that is disposed so that the distance from the second end of said first matching conductor to the center point of said main conductor is much less than the length of the operating wavelength;

(c) a second matching conductor, that is approximately straight, that has a length that is approximately one-half of the length of said main conductor, that is disposed approximately parallel to said main conductor but is disposed on the opposite side of said main conductor than is disposed said first matching conductor, that is disposed so that the distance from the first end of said second matching conductor to said center point of said main conductor is much less than the length of the operating wavelength, and that is disposed so that the distance from the second end of said second matching conductor to the second end of said main conductor is much less than the length of the operating wavelength;

(d) a first shorting conductor connecting said first end of said main conductor to said first end of said first matching conductor;

(e) a second conductor connecting said second end of said main conductor to said second end of said second matching conductor; and (f) means for connecting any associated electronic equipment between said second end of said first matching conductor and said first end of said second matching conductor so that the connection is balanced with respect to said center point of said main conductor.

2. The antenna structure of claim 1 wherein at least one of the conductors has an approximately circular cross-sectional area.

3. The antenna structure of claim 1 wherein at least one of the conductors is a solid rod.

4. The antenna structure of claim 1 wherein at least one of the conductors is tubular.

5. The antenna structure of claim 1 wherein all the conductors have equal cross-sectional areas.

6. The antenna structure of claim 1 wherein the conductors do not have equal cross-sectional area.

7. An antenna comprising a plurality of sets of conductors, such that:

(a) in each of said sets of conductors, there is a main conductor that is approximately straight;

(b) in each of said sets of conductors, there is a first matching conductor that is approximately straight, that has a length that is approximately one-half of the length of said main conductor, that is disposed approximately parallel to said main conductor, that is disposed so that the distance from the first end of said first matching conductor to the first end of said main conductor is much less than the length of the operating wavelengths, and that is disposed so that the distance from the second end of said first matching conductor to the center point of said main conductor is much less than the length of the operating wavelengths:

(c) in each of said sets of conductors, there is a second matching conductor that is approximately straight, that has a length that is approximately one-half of the length of said main conductor, that is disposed approximately parallel to said main conductor but that is disposed on the opposite side of said main conductor than is disposed said first matching conductor, that is disposed so that the distance from the first end of said second matching conductor to said center point of said main conductor is much less than the length of the operating wavelengths, and that is disposed so that the distance from the second end of said second matching conductor to the second end of said main conductor is much less than the length of the operating wavelengths;

(d) in each of said sets of conductors, there is a first shorting conductor connecting said first end of said main conductor to said first end of said first matching conductor;

(e) in each of said sets of conductors, there is a second shorting conductor connecting said od end of said main conductor to said second end of said second matching conductor;

(f) said sets of conductors are disposed so that the main conductors are approximately in a plane and are approximately parallel to each other;

(g) said sets of conductors are disposed so that said center points of said main conductors approximately are aligned in the direction perpendicular to said main conductors;

(h) in each of said sets of conductors, the matching conductors and said main conductors are approximately in planes that are approximately perpendicular to said plane of said main conductors;

(i) said aching conductors on either side of said plane of said main conductors are connected to alternate ends of said main conductors in alternate sets of conductors;

(j) the lengths of said main conductors of said sets of conductors are progressively and approximately proportionally shorter from the rear to the front of said antenna;

(k) the distances between said sets of conductors are progressively and approximately proportionally shorter from the rear to the front of said antenna;

(l) the ratio of said lengths of said main conductors of each pair of adjacent sets of conductors and the ratio of the adjacent distances between said sets of conductors are approximately equal ratios;

(m) said sets of conductors are connected to each other by two approximately straight feeder conductors, one on either side of said plane of said main conductors, that connect to the unconnected ends of each of said matching conductors of said sets of conductors;

(n) said feeder conductors are such that the phase relationship produced by the time taken for the energy to travel between said sets of conductors by said feeder conductors is approximately equal to the phase relationship that is consistent with travel at the speed of light; and (o) the front ends of said two feeder conductors are connected to any associated electronic equipment in a balanced manner.

8. The antenna of claim 7 further including a supporting boom connected to said center points of said main conductors.

9. The antenna of claim 7 wherein said main conductors are approximately parallel to the ground.

10. e a nd of claim 7 wherein said main conductors are approximately perpendicular to the ground.

11. The antenna of claim 7 wherein said main conductors are neither approximately parallel to the ground nor approximately perpendicular to the ground.

12. The antenna of claim 7, further including:

(a) an extension of said feeder conductors to a point approximately one-eighth of the lowest operating wavelength beyond the largest set of conductors; and (b) a terminating component connected between said feeder conductors at their ends beyond said largest set of conductors.

* * * * *

UNITED STATES PATENT AND TRADEMARK OFFICE

CERTIFICATE OF CORRECTION

PATENT NO. : 6,121,937
DATED : September 19, 2000
INVENTOR(S) : James Stanley Podger It is certified that error appears in the above-identified patent and that said Letters Patent is hereby corrected as shown below:

In column 2, line 20, delete "as 18."

In column 2, line 53, replace "its" with --is--.

In the first line of claim paragraph 1(e), between "second" and "conductor" insert --shorting--.

In the fourth line of claim paragraph 1(f), between "is" and "balanced" insert --approximately--.

In the second line of claim 6, replace "area" with --areas--.

In the second line of claim paragraph 7(e), replace "od" with --second--.

In the first line of claim paragraph 7(i), replace "aching" with --matching--.

In the second line of claim paragraph 7(o), replace "a" with --an approximately--.

In the first line of claim 10, replace "e a nd" with --The antenna--.

Signed and Sealed this

First Day of May, 2001

*Attest:*

Nicholas P. Godici

NICHOLAS P. GODICI

*Attesting Officer*

*Acting Director of the United States Patent and Trademark Office*